US006279669B1

(12) United States Patent
Swietlik et al.

(10) Patent No.: US 6,279,669 B1
(45) Date of Patent: Aug. 28, 2001

(54) INDEXING MECHANISM AND APPARATUS INCORPORATING THE SAME

(75) Inventors: George Swietlik, Lowestoft; Malcolm Adrian Abbott, Halesworth, both of (GB)

(73) Assignee: Pilot DRilling Control Limited, Lowestoft (DE)

( * ) Notice: Subject to any disclaimer, the term of this patent is extended or adjusted under 35 U.S.C. 154(b) by 0 days.

(21) Appl. No.: 09/415,853

(22) Filed: Oct. 8, 1999

(30) Foreign Application Priority Data

Oct. 12, 1998 (GB) ..... 9822211

(51) Int. Cl.[7] ..... E21B 21/10; E21B 23/00

(52) U.S. Cl. ..... 175/73; 175/65

(58) Field of Search ..... 175/73, 65, 107, 175/317, 232, 320, 302, 243, 76, 38, 61, 92

(56) References Cited

U.S. PATENT DOCUMENTS

| | | |
|---|---|---|
| 4,298,077 | 11/1981 | Emery . |
| 4,895,214 | 1/1990 | Schoeffler . |

FOREIGN PATENT DOCUMENTS

| | | |
|---|---|---|
| 2245623 | 1/1992 | (GB) . |
| 2273514 | 6/1994 | (GB) . |
| 2314106 | 12/1997 | (GB) . |
| 9630621 | 10/1996 | (WO) . |

OTHER PUBLICATIONS

*Pilot Drilling Control Ltd.* entitled "Conventional Directional Drilling Tools"–No date.

*Pilot Drilling Control Ltd.* entitled "What does this project mean to the Drilling Industry"–No date.

"How the Indexer CAM Works"–No date.

How Things Work, pp. 312 and 313, entitled "Ballpoint Pen" –No date.

*Primary Examiner*—Robert E. Pezzuto
(74) *Attorney, Agent, or Firm*—Seyfarth Shaw

(57) ABSTRACT

Within a longitudinally-extending main housing having a longitudinally-extending duct, an indexing mechanism comprises a mandrel within the duct and capable of longitudinal movement relative to the main housing; a cam sleeve rotatable with respect to the mandrel but constrained in terms of longitudinal movement with respect to the mandrel, the cam sleeve having an external surface provided with a groove in the form of a closed loop; a cam follower resiliently urged into the groove of the cam sleeve; a main spring tending to urge the mandrel in a first direction along the duct; and a fluid abutment face, on which, in use, fluid under pressure can act to tend to urge the mandrel in a second direction opposite to the first direction; the groove having ramps and associated steps thereby restricting relative movement of the cam follower with respect to the groove, to one direction progressively around the closed loop; the groove having a plurality of rest positions at which the cam follower can rest, depending on which of the force of the main restoring means and the force of the fluid pressure dominates the other.

27 Claims, 17 Drawing Sheets

INDEXING MECHANISM AND APPARATUS INCORPORATING THE SAME

BACKGROUND

This invention relates to an indexing mechanism and to apparatus incorporating the same. In various industries, for example the oil extraction industry, it is necessary to control certain pieces of equipment at a considerable distance from where the operator is positioned. In some industries this can be achieved by the use of radio-controlled apparatus, but this is not practicable with submarine or subterranean drilling exercises. The control apparatus can, in certain technical fields, be actuated by electrical signals passed through conventional electrical conductors but this is not satisfactory in the field of drilling for oil or gas, where severe conditions are encountered.

In the drilling field a drill string, formed of lengths of drill pipe joined in end-to-end relationship, is fed down the wellbore. Whilst it may be desirable to actuate certain apparatus at intermediate regions along the length of the drill string, often the most important apparatus to control is at that part of the drill string furthest from the operator, i.e. near the drill bit. Generally speaking the drill string can be regarded as a hollow duct, through which drilling fluid (also known as drilling mud) is passed under pressure. Under certain circumstances it is desirable to allow the drilling fluid being passed under pressure down the drill string to by-pass the drilling bit, by venting through lateral ports and being allowed to return up the bore hole. Thus, it is desirable to be able to control effectively the opening and closing of such ports or the access to, and shutting off of, such ports.

Furthermore, it may also be desirable to actuate a stabiliser incorporated in the drill string. Such a stabiliser may have a plurality of elements capable of being moved radially outwardly, under suitable actuation, so as to engage the internal surface of the wellbore, such elements and the sleeve with which they are associated then remaining prevented from rotation relative to the wellbore, whereas the mandrel within the sleeve, which mandrel forms part of the main duct of the drill string, is free to continue to rotate.

Moreover, in a three-dimensional steering tool where there is an articulated joint it is necessary to impart some degree of eccentricity to the drill string immediately upstream of the joint, the effect of which is that the drill bit, on the remote side of the articulated joint, is forced out of a rectilinear relationship, thereby enabling the drill string to be "steered".

SUMMARY

According to a first aspect of the present invention, there is provided, within a longitudinally-extending main housing having a longitudinally-extending duct, an indexing mechanism which comprises:

a mandrel within the duct and capable of longitudinal movement relative to the main housing;

a cam sleeve mounted for rotation on, and with respect to, the mandrel but constrained in terms of longitudinal movement with respect to the mandrel, the cam sleeve having an external surface provided with a groove in the form of a closed loop;

a cam follower mounted relative to the main housing and resiliently urged into the groove of the cam sleeve;

main restoring means tending to urge the mandrel in a first direction along the duct; and a fluid abutment face, on which, in use, fluid under pressure can act to tend to urge the mandrel in a second direction opposite to the first direction;

wherein the groove has ramps and associated steps thereby restricting relative movement of the cam follower with respect to the groove, to one direction progressively around the closed loop; and wherein the groove has a plurality of rest positions at which the cam follower can rest, depending on whether the force of the main restoring means dominates the force of the fluid pressure, or vice versa:

the arrangement of the indexing mechanism being such that, with the main restoring means initially dominating the force of the fluid pressure, the mandrel is urged in the first direction and carries the cam sleeve in the first direction until the cam follower has travelled a first leg of the closed loop and comes to a first rest position in the groove; but when the fluid pressure is increased so that the force of the fluid pressure exceeds the force of the main restoring means, the mandrel is moved in the second direction, carrying the cam sleeve with it, the cam follower moving along the next leg of the closed loop of the groove until a second rest position is reached, and remaining there until the fluid pressure is reduced sufficiently such that the force of the main restoring means exceeds again the force of the fluid pressure, whereupon the mandrel moves again in the first direction, carrying the cam sleeve with it, with the cam follower travelling along a third leg of the closed loop to a third rest position, and so on, until a complete cycle of the closed loop is effected.

The groove can be thought of as having a plurality of legs, each comprising a ramp terminating in a step. The cam follower rises along each ramp and, at the end thereof, drops down the step to a rest position. The step is such that the cam follower cannot "climb" back up the step, but can only move forward along the next leg in a progressive manner, i.e. as a positive index.

In one convenient arrangement of the indexing mechanism the closed loop of the groove appears on only part of the circumferential external surface of the cam sleeve such that, in operation, during one complete cycle with the cam follower following the whole of the closed loop, the cam sleeve will rotate in opposite directions about its longitudinal axis.

In an alternative convenient arrangement of the indexing mechanism, the closed loop of the groove extends around the whole circumference of the cam sleeve such that, in operation, during one complete cycle the cam sleeve will undergo one complete revolution about its longitudinal axis.

Preferably the cam follower is a ball urged by resilient means into the groove, with the resilient means preferably being a compression spring. Preferably the ball moves radially in a bore in the main housing, which is radial with respect to the main longitudinal axis of the indexing mechanism. The ball is free to rotate about its own centre; and it rises and falls as it follows the ramps and steps of the groove.

Depending on the mode of operation, it is possible, for example, for the groove to have four steps and four rest positions.

Another convenient arrangement is that wherein the groove has six steps and six rest positions.

The main restoring force is conveniently a major compression spring.

Conveniently the fluid abutment face is a perforated plate on which fluid under pressure moving in the second direction can act so as to tend to cause the mandrel to move in the second direction.

Preferably the indexing mechanism includes bearing assemblies to assist in free rotation of the cam sleeve relative to the mandrel.

Preferably the mandrel is provided with sealing mechanisms for sealing the mandrel with respect to the internal surface of the duct of the main housing.

Depending on what the indexing mechanism is to assist in controlling, the mechanism usually includes actuating means associated with the mandrel and capable of reciprocating longitudinal movement in the first and second directions with the mandrel.

In the oil exploration field, a preferred arrangement is that wherein the mandrel is hollow and the actuating means is also hollow, whereby fluid under pressure moving in the second direction can pass through the hollow bore within the mandrel and through the actuating means.

According to a second aspect of the present invention, there is provided a drill string portion which includes a main housing incorporating an indexing mechanism in accordance with the first-mentioned aspect of the present invention, and an upper housing connection and a lower housing connection connected to opposite end regions of the main housing.

According to a third aspect of the present invention, there is provided a by-pass tool which includes a drill string portion according to the second-mentioned aspect of the present invention, wherein the main housing includes one or more lateral ports and the actuating means includes a pipe capable of forming a fluid-tight communication with another pipe such that when the two pipes are in fluid-tight communication fluid being introduced under pressure through the hollow region of the mandrel passes through the two pipes and is prevented from escaping to the port(s), the two pipes being in fluid-tight communication when the mandrel and cam sleeve have undergone maximum permitted travel in the second direction.

Conveniently one of the pipes includes a male nozzle component capable of cooperating with a female portion on the other of the pipes.

According to a fourth aspect of the present invention, there is provided a drill string portion in accordance with the second aspect of the present invention, which is provided with stabilising facilities, the facilities including elements which can be moved radially outwards so as to engage the internal face of a well bore, the elements being resiliently urged radially inwards but being associated with camming means associated with the actuating means such that, when the mandrel moves in the second direction, the actuating means are correspondingly moved and this actuates the camming means so as to cause outward radial movement of the stabilising elements, overcoming the resilient means tending to urge them inwards.

According to a fifth aspect of the present invention, there is provided a drill string portion in accordance with the second mentioned aspect of the present invention which includes a three-dimensional rotary steering tool in addition to the indexing mechanism, the steering tool including a sleeve capable of free rotation about a housing, and the sleeve being provided with a pad capable of inward and outward radial movement, wherein the pad is normally retracted relative to the sleeve and a locking means normally serves to prevent relative rotational movement between the sleeve and the associated housing, the locking means being operated by a cam forming part of the actuating means associated with the indexing mechanism; the arrangement being such that, with the mandrel moving in the second direction, the cam is actuated so as to cause the locking means to move in such a way as to cause the sleeve to be locked relative to the housing, this also causing the pad to be retracted relative to the sleeve against other resilient means; and such that, when the mandrel is moved in the first direction, the cam is moved longitudinally so as to allow the locking pin to move radially inwardly in the housing, thereby allowing free rotation of the sleeve relative to the housing, and also allowing the other resilient means to cause the pad to be urged radially outwards, thus creating an eccentric configuration.

Preferably the drill string portion including the three-dimensional rotary steering tool in accordance with the fifth-mentioned aspect of the present invention also includes an articulated drive mechanism, with the arrangement being such that, with the pad being extended in one radial direction, the resultant effect through the articulated drive mechanism is to cause a drill bit to move in the same general direction as the extended pad, whereby steering can be achieved.

According to a sixth aspect of the present invention, there is provided a drill string portion which includes a 3-dimensional rotary steering tool and which also incorporates an indexing mechanism in accordance with claim 13, the steering tool including a sleeve capable of free rotation about a housing, the housing having an axis and a circular exterior of which the centre lies on the axis, the sleeve having a circular interior for rotation about the exterior of the housing and having an offset exterior having an axis which is offset with respect to that of the housing, wherein a locking means normally serves to prevent relative rotational movement between the sleeve and the associated housing, the locking means being operated by a com forming part of the actuating means associated with the indexing mechanism; the arrangement being such that, with the mandrel moving in the second direction, the cam is actuated so as to cause the locking means to move in such a way as to cause the sleeve to be locked relative to the housing;

and such that, when the mandrel is moved in the first direction, the cam is moved longitudinally so as to cause the locking means to move in such a way as to allow free rotation of the sleeve relative to the housing, whereby in use the sleeve becomes stationary relative to a wellbore and, because of the offset nature of the stationary sleeve, steering of the steering tool is achieved.

Preferably such a drill string portion also includes an articulated drive mechanism, with the arrangement being such that, with the eccentric housing being extended in one radial direction, the resultant effect through the articulated drive mechanism is to cause a drill bit to move in the same general direction as the eccentric housing, whereby steering can be achieved.

BRIEF DESCRIPTION OF THE DRAWINGS

For a better understanding of the present invention and to show how the same may be carried into effect, reference will now be made, by way of example, to the accompanying drawings, in which.

DETAILED DESCRIPTION

Figure 3:
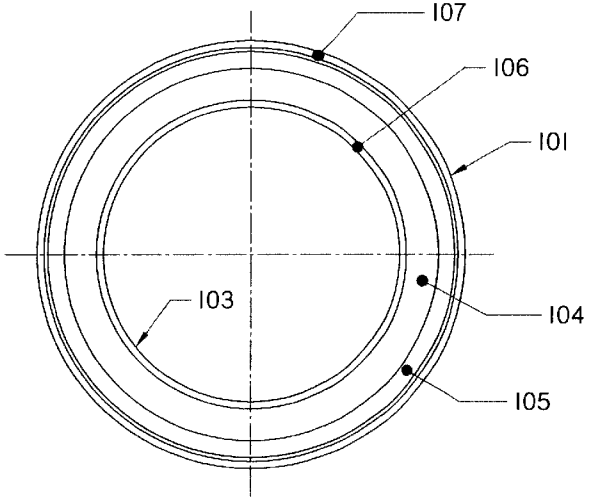
FIG. 3 is an end view of the cam sleeve of FIG. 1.
Figure 1:
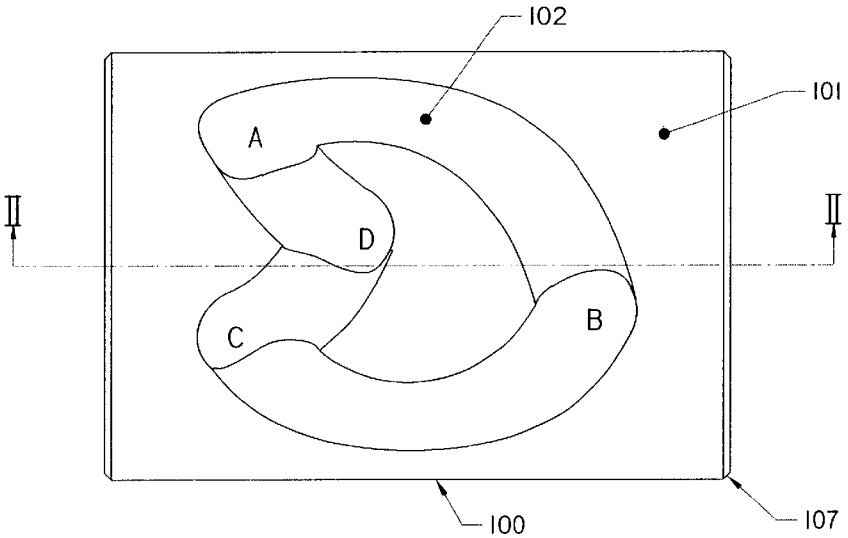
FIG. 1 is a side view of one embodiment of a cam sleeve forming part of an indexing mechanism of the present invention.
Figure 2:
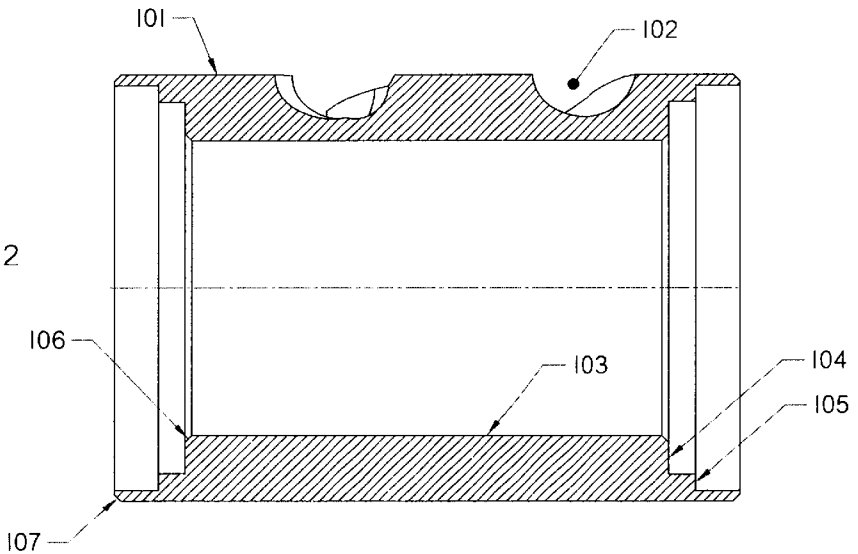
FIG. 2 is a longitudinal section taken along the line II—II in FIG. 1.

Referring firstly to FIGS. 1, 2 and 3, there is shown one embodiment of a cam sleeve forming part of an indexing mechanism in accordance with the present invention. The sleeve is generally indicated by the reference numeral 100, and it has a generally cylindrical external surface 101, in which is provided a generally heart-shaped groove 102 which is to serve as the track to be followed by the cam follower. Extending along the main axis of the cam sleeve 100 is a through bore 103, and at each end there is an inner step 104 and an outer step 105. Also at each end are an inner bevel 106 and an outer bevel 107.

Figure 4:
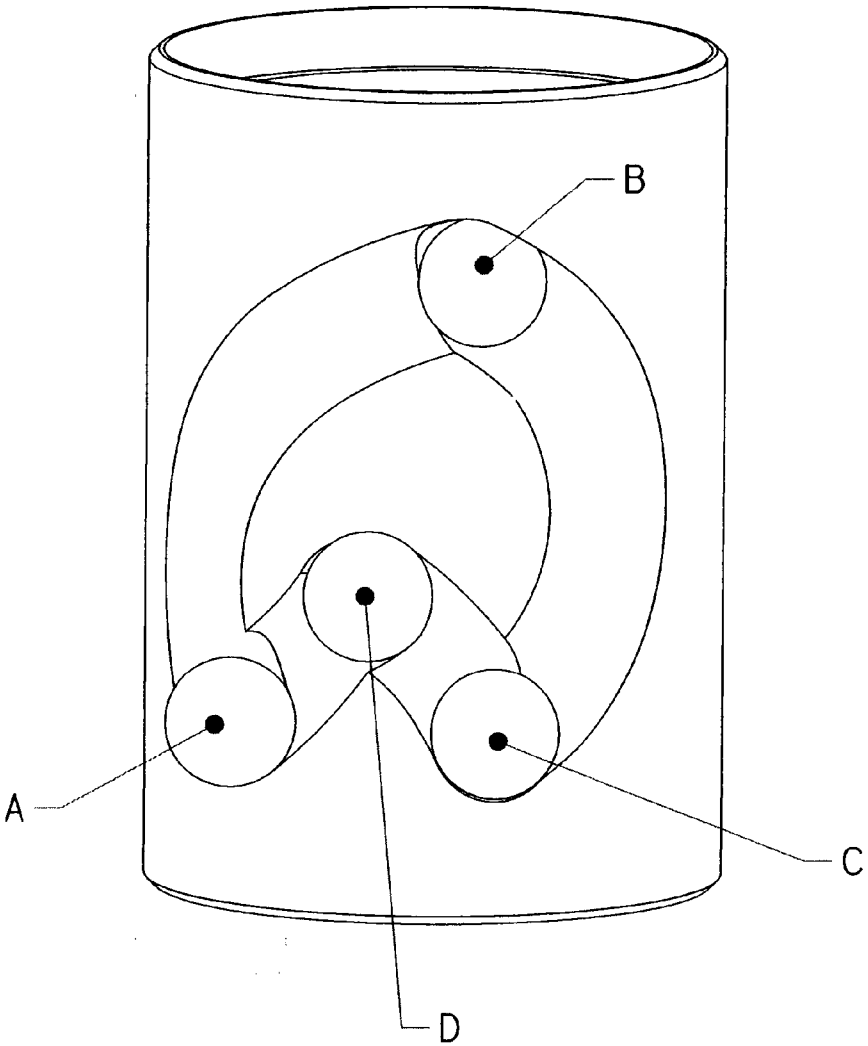
FIG. 4 is an enlarged side view of the cam sleeve of FIG. 1.

As shown in FIG. 1, the groove 102 effectively has four apices marked A, B, C, and D, which serve as rest positions. As will readily be appreciated from what has already been stated, there is relative movement between the cam follower and the groove 102 of the cam sleeve 100. In fact, the cam follower remains stationary in longitudinal terms relative to the main housing, but is free to move radially inwardly and outwardly with regard to that housing, being urged into the groove 102 by, for example, a compression spring. It is the cam sleeve 100 which is free to rotate within, and to move longitudinally with respect to, the main housing, within the limits controlled by the action of the cam follower in the groove 102. Although it is easy to think of the cam follower as following the groove from position A, to position B, to position C, and onto position D, in reality the cam follower is staying stationary (apart from its radial movement) and it is the cam sleeve 100 which is moving relative to cam follower.

Where the cam follower is a ball bearing, it can have the four rest positions A, B, C, and D, as clearly shown in FIG. 4.

Moreover although not clearly shown in FIGS. 1 and 4, the groove consists of a series of ramps and associated steps, which enables the cam follower to "climb" a ramp, against the action of the aforementioned compression spring, and then, when it reaches the next step, to "fall" down the step into the next rest position. It is a change in the dominant force acting on the mandrel (about which the cam sleeve 100 is free to rotate) which causes the mandrel to move longitudinally with the result that the cam follower is caused to move along the next ramp to the next rest position.

Figure 5:
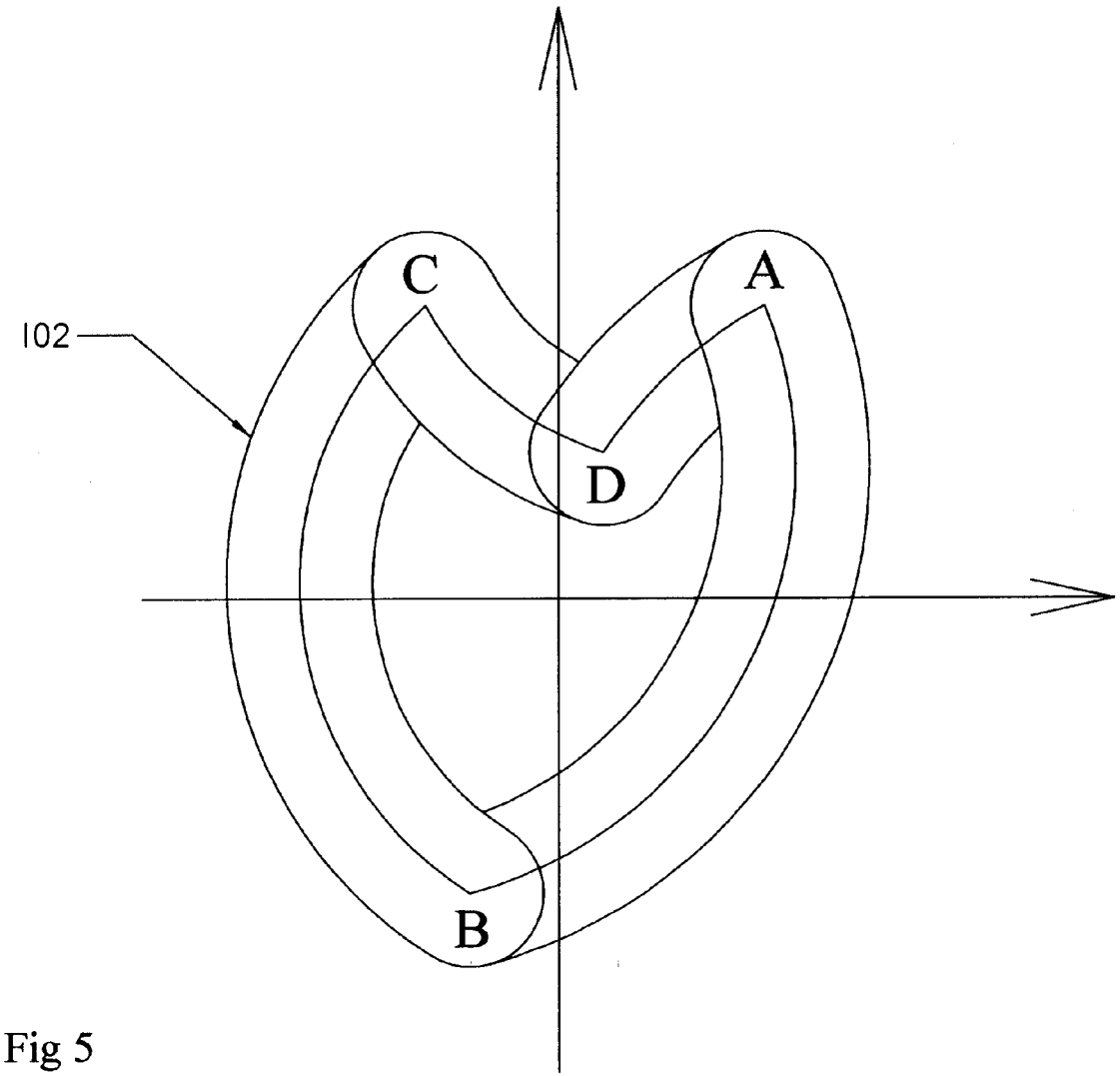
FIG. 5 is a detailed view of the cam sleeve of FIG. 1.

FIG. 5 shows more accurately the configuration of the groove 102 of the cam sleeve 100, showing the rest positions A, B, C, and D. It is to be appreciated that there is no start position in view of the closed loop nature of the groove. The equipment, in operation, can start with the cam follower in any position and the cam follower will follow the ramp from one position towards the next rest position and, just as it approaches that next rest position, it falls down a small step. The step is provided to prevent the cam follower from moving back towards the first-mentioned rest position when there is a change in resultant force on the mandrel which carries the cam sleeve 100, thus ensuring that the cam follower moves off, in a clockwise direction along the groove 102, by following the next ramp to the subsequent rest position.

Figure 6:
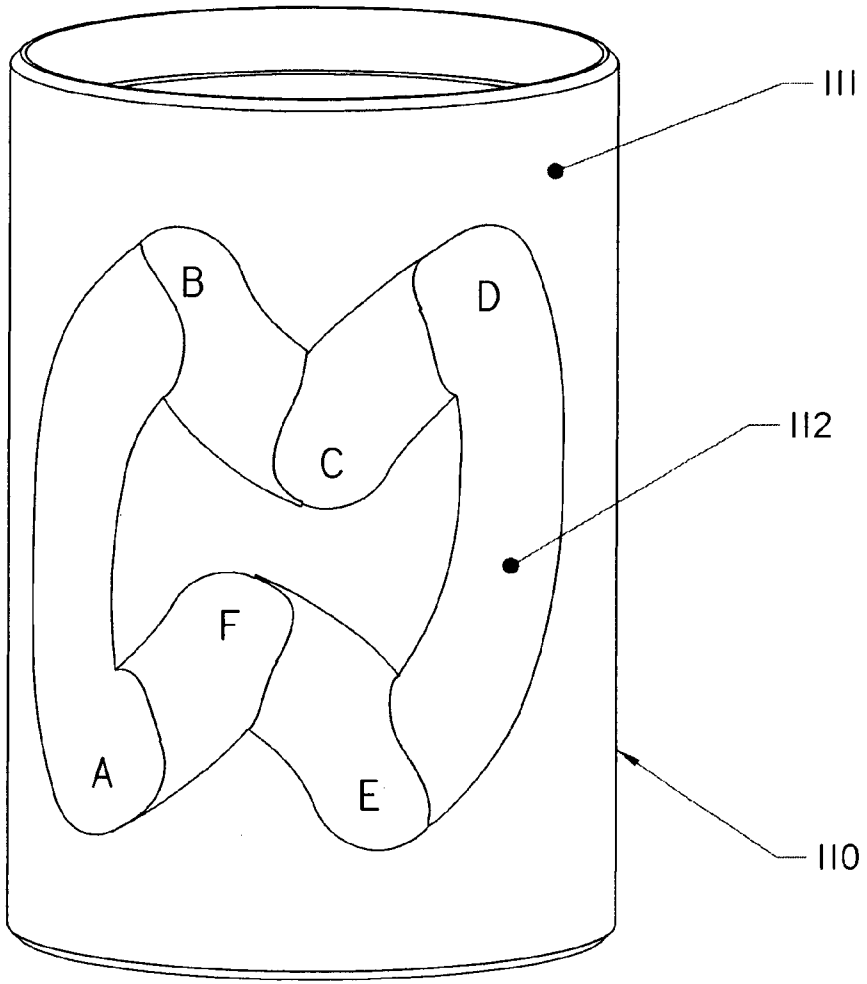
FIG. 6 is a side view of an alternative embodiment of cam sleeve.

FIG. 6 shows an alternative embodiment of cam sleeve 110 which has a cylindrical exterior surface 111 in which is provided a closed-loop groove 112. Unlike the groove 102 which has four ramps, four steps and four rest positions A, B, C, and D, the arrangement shown in FIG. 6 has six ramps, six steps and six rest positions A, B, C, D, E, and F. When the cam follower in the form of a ball bearing is in the rest positions B and D, the cam sleeve and associated mandrel are at one limit (upstream) of their longitudinal travel, and when the ball bearing is at the rest positions A and E the cam sleeve and associated mandrel are at the opposite limit of travel. There are two additional, intermediate, rest positions C and F.

Figure 7:
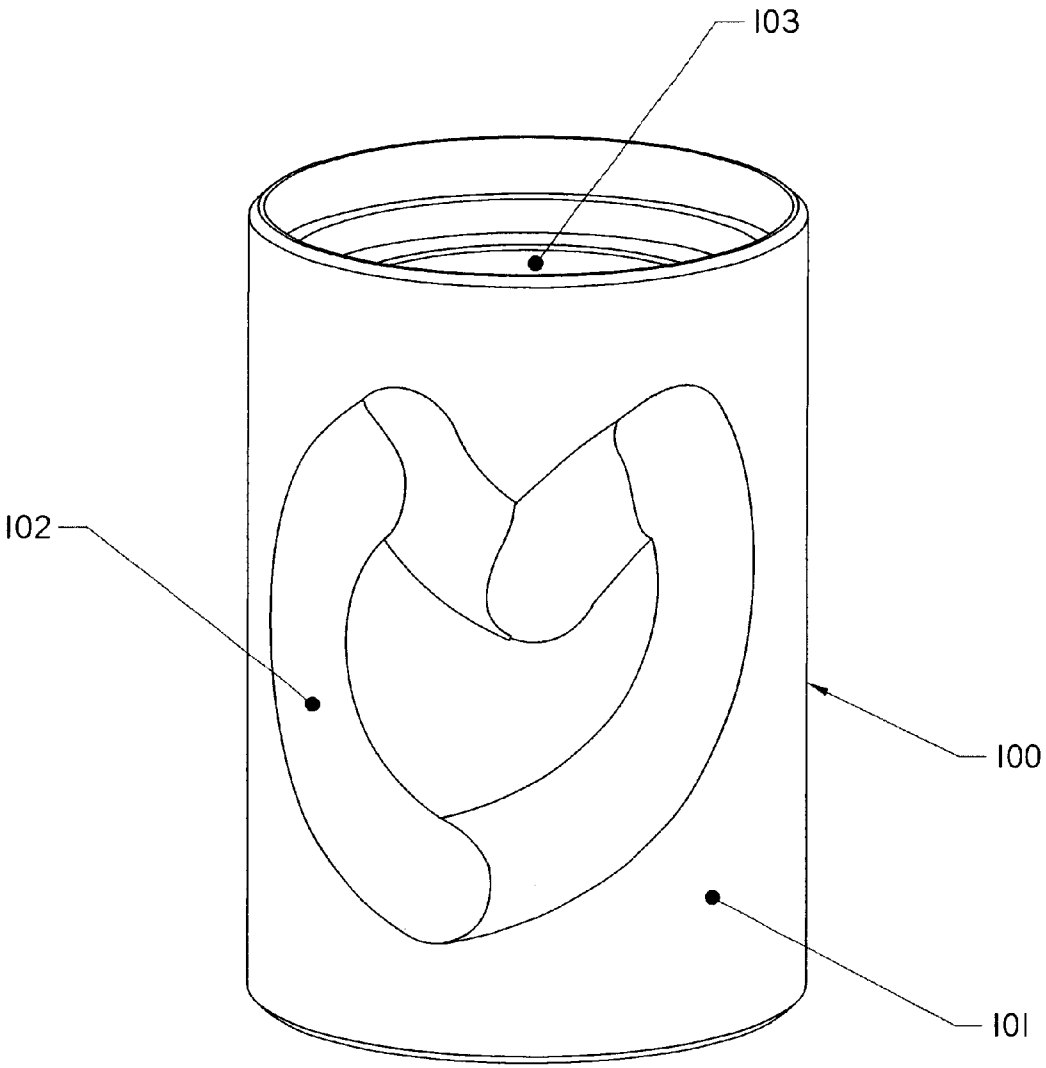
FIG. 7 is a perspective view of the cam sleeve of FIG. 1.

FIG. 7 is a perspective view of the cam sleeve of FIG. 1.

Figure 8:
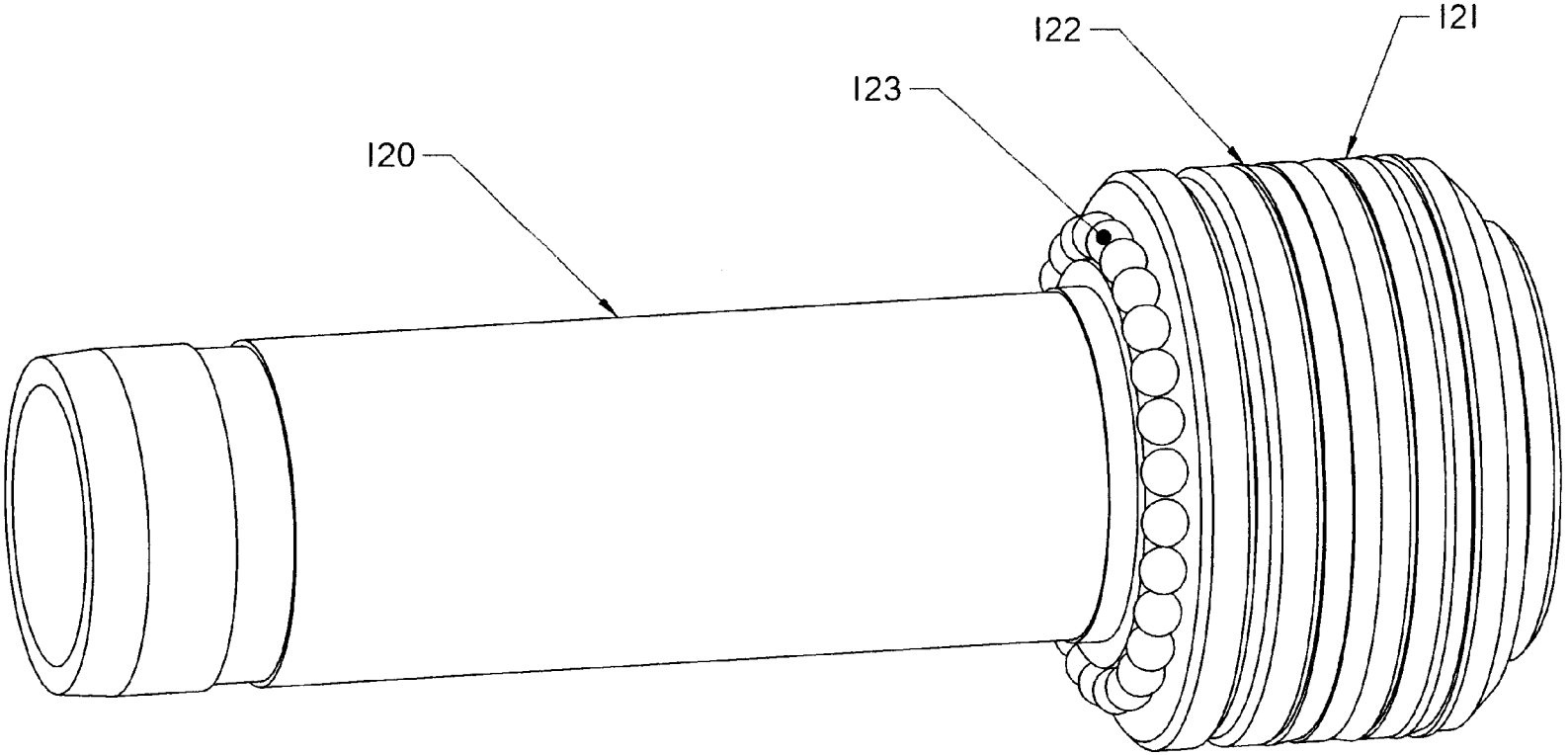
FIG. 8 is a perspective view of a mandrel and bearing and sealing assembly, for use with the cam sleeve of FIG. 7.

FIG. 8 shows a mandrel 120 provided, at one end region, with a bearing and sealing assembly 121. The assembly 121 has a sealing component 122 intended to fit sealingly within a bore in a main housing, and the assembly 121 also has a bearing component 123 intended to abut one end region of the cam sleeve 100 (of FIG. 7) so as to locate and facilitate rotation of the cam sleeve 100 relative to the mandrel 120.

Figure 9:
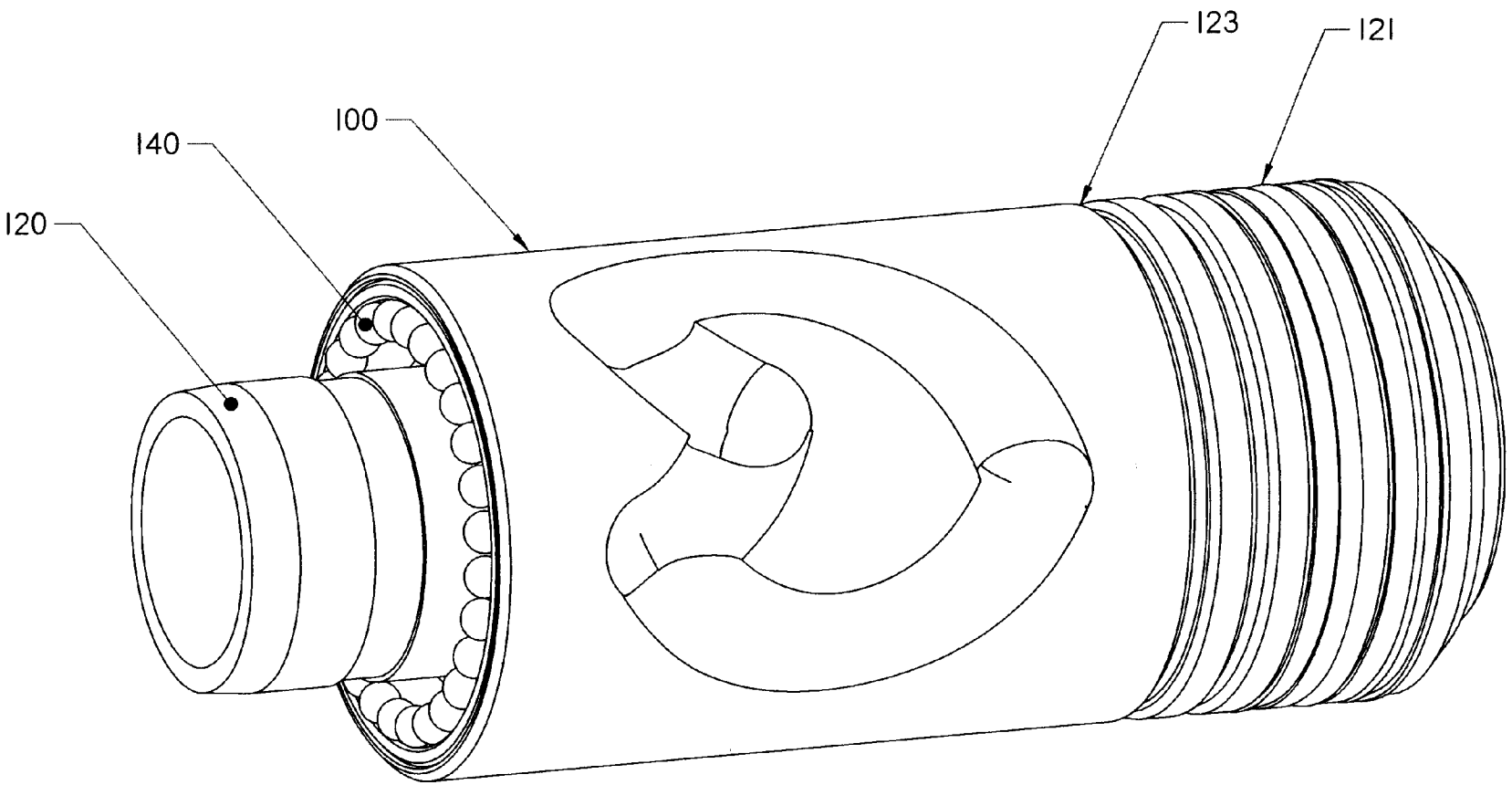
FIG. 9 is a perspective view of part of an indexing mechanism, showing the cam sleeve of FIG. 7 located on the mandrel of FIG. 8.

FIG. 9 shows the cam sleeve of FIG. 7 located on the mandrel 120 of FIG. 8, with one end region of the cam sleeve 100 abutting the bearing component 123 of the assembly 121, an additional sealing ring 124 being provided at the opposite end region of the cam sleeve 100. The sealing ring 124 need only contend with sliding movement relative to the main housing 131.

Figure 10:
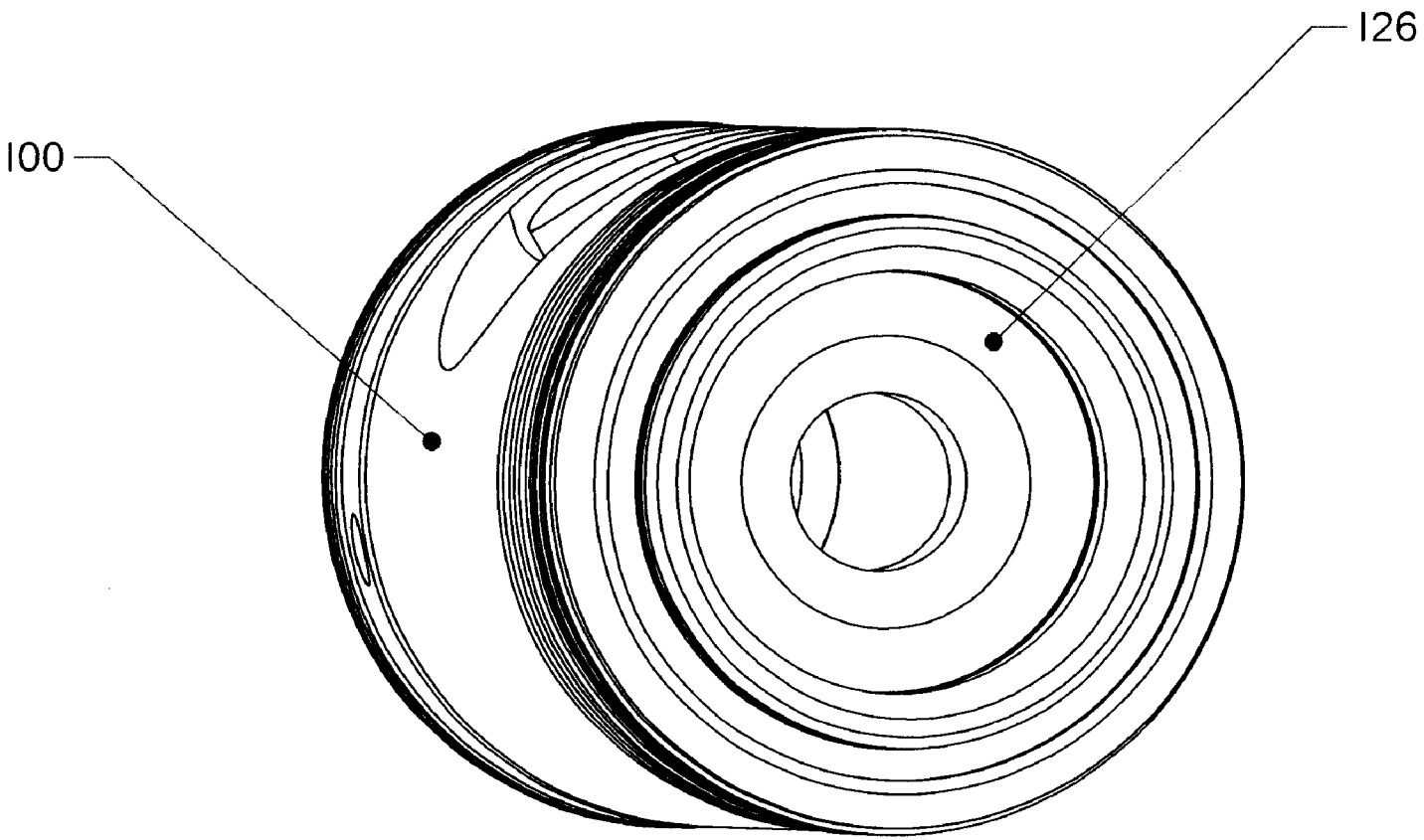
FIG. 10 is an end view of a fully assembled indexing mechanism, incorporating the components shown in FIG. 9.

FIG. 10 shows a perspective end view of the indexing mechanism comprising the cam sleeve 100 mounted on the mandrel 102 with the appropriate sealing and bearing components in place. The end face takes the form of a choke plate 126 so as to provide a face onto which fluid under pressure may act so as to tend to cause the indexing mechanism to move away under the action of that pressure. This will be explained in more detail hereafter. It is, however, the action of that pressure which causes the mandrel to move away, carrying with it the cam sleeve 100 which is limited in its longitudinal, and rotational, movement by the action of the cam follower in the groove 102, as will become clearer in the following FIG. 11 which shows a main assembly in which the indexing mechanism is used to open or close a by-pass.

Figure 11:
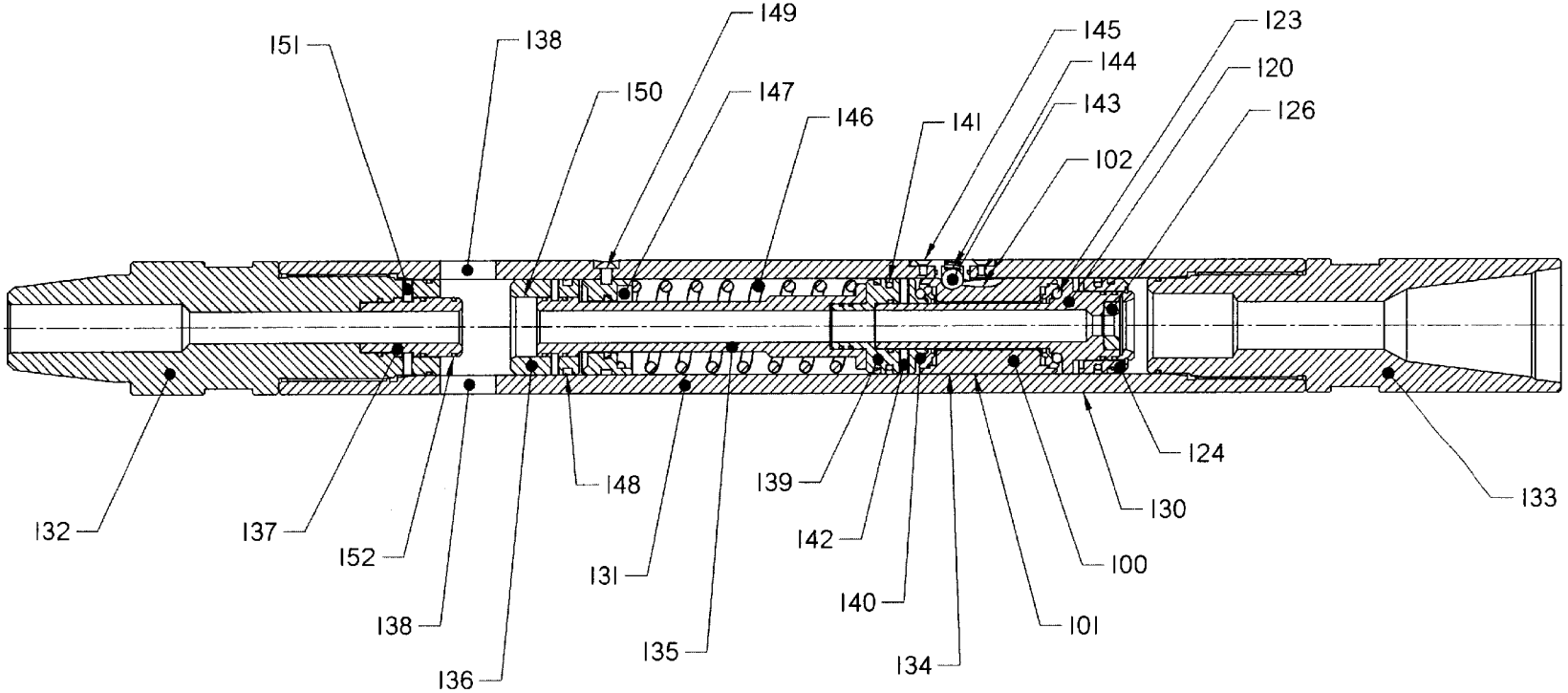
FIG. 11 is a longitudinal section through a main assembly incorporating an indexing mechanism of the type generally illustrated in earlier figures.
Figure 12:
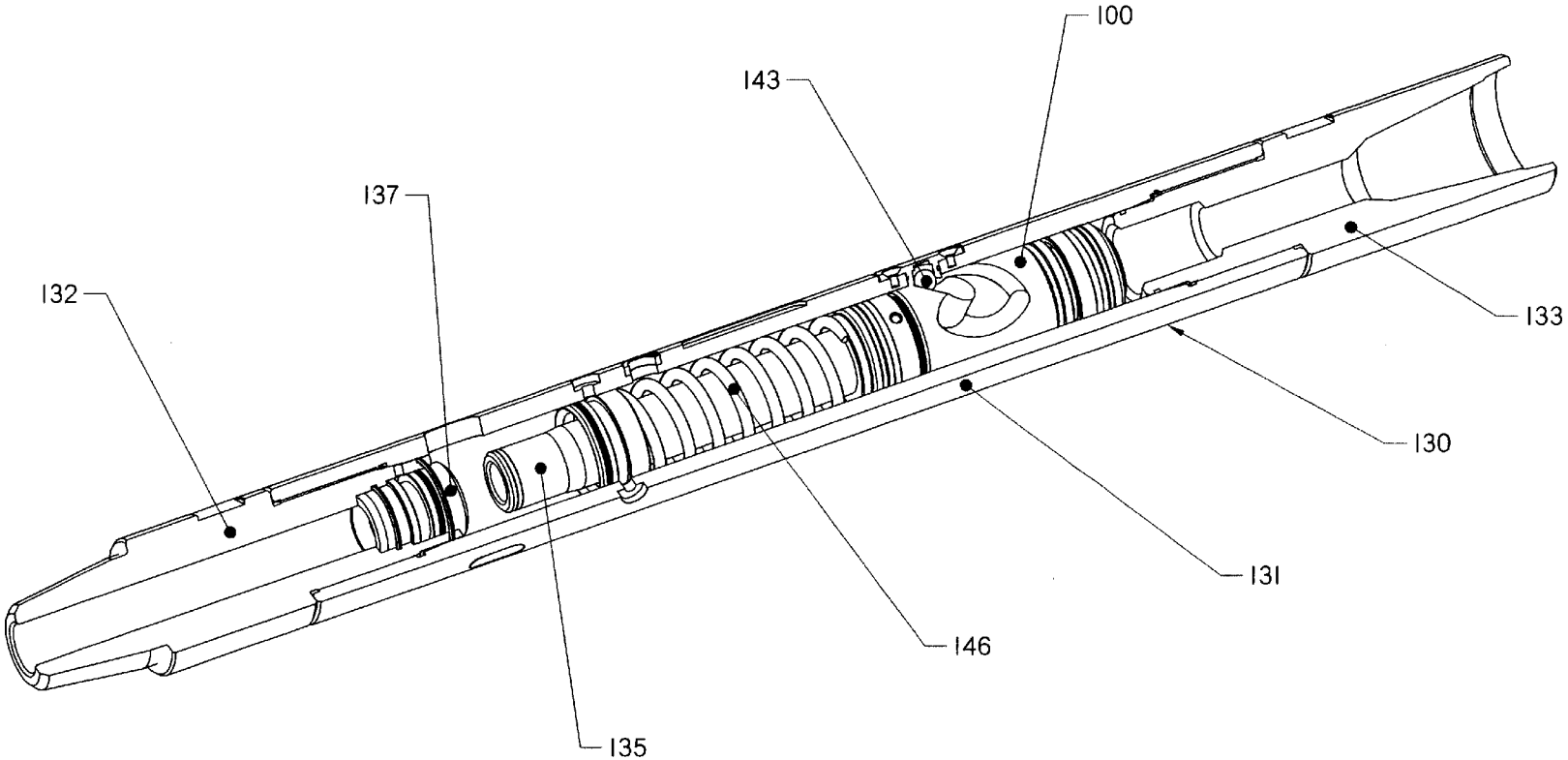
FIG. 12 is a photographic, perspective, cut-away view of the equipment shown in FIG. 11.

Referring now to FIG. 11, there is shown a main assembly which includes a by-pass and which also incorporates an indexing mechanism in accordance with the present invention, the indexing mechanism generally being of the type illustrated in earlier figures. Even though, dimensionally, certain of the components of the indexing mechanism illustrated in FIG. 11 are different from the corresponding components illustrated in earlier figures, nonetheless those figures will be identified by the same reference numerals, for consistency and ease of comprehension.

In FIG. 11 the main by-pass assembly is generally indicated by the reference numeral 130 and includes a main housing 131, which is generally tubular in configuration. Secured to one end region of the main housing 131 is a conventional lower housing connector 132, and secured to the other end region of the main housing 131 is a conventional upper housing connector 133. The indexing mechanism already illustrated in detail in earlier drawings is shown within the main housing 131 and is generally indicated by the reference numeral 134. Located between the indexing mechanism 134 and the lower housing connector 132 is a piston assembly generally indicated by the reference numeral 135. The piston assembly 135 is secured to one end region of the indexing mechanism 134 and carries, at its other end region, a shroud 136 capable of forming a sealing engagement with a nozzle 137 at the upstream end of the usual bore within the lower housing connector 132, whereby fluid introduced into the upper housing connector 133 may pass through the indexing mechanism 134, through the piston assembly 135, through the shroud 136, through the nozzle 137 and into the bore of the lower housing connector 132. When, however, as shown in FIG. 11, the shroud 136 is longitudinally spaced from the nozzle 137, fluid passing downwards through the interior of the piston assembly 135 may escape laterally through a plurality of ports 138 in the main housing 131, two such ports 138 being shown in FIG. 11.

As mentioned in relation to FIG. 8, there is a bearing component 123 at one end (in fact the upstream end) of the mandrel 120 to rotatably locate the cam sleeve 100 for rotation relative to the mandrel 120. In order to permit free rotation between the cam sleeve 100 and an adjacent sub-part 139 of the mandrel, there is a further bearing component 140 at the lower end region of the cam sleeve 100. The intermediate member (sub-part) 139 is provided with its own sealing system 141 bearing against the internal surface of the main housing 131 and is also provided with means 142 for securing the intermediate member 139 to the mandrel 120. The sealing system 141 is to provide a seal during sliding movement.

Partially accommodated within the groove 102 of the cam sleeve 100 is a ball, in a form of a ball bearing 143, which is urged into the groove 102 by resilient means 144 (such as a compression spring) held in place by screws 145.

The aforementioned piston assembly 135 is in fluid communication with the interior of the intermediate member 139 which, in turn, is in fluid communication with the interior of the indexing mechanism 134 which, in turn, is in fluid communication with the interior of the upper housing connection 133.

Lying outside the piston assembly 135 is a compression spring 146 one end region of which acts on a flange on the piston assembly, urging it in the upstream direction (i.e. to the right in FIG. 11), the other end region of the spring 146 acting on an abutment plate 147 secured in relation to the main housing 131 by a bolt 149 and sealed with respect to the housing 131 by an O ring 148.

Secured to the downstream end region of the piston assembly 135 is the shroud 136 which includes a tapered abutment face 150 capable of forming a tight seal with the nozzle 137 which is secured by a bolt 151 within the upstream mouth region of the lower housing connector 132.

With the equipment shown in FIG. 11 in the configuration illustrated in FIG. 11, it can be appreciated that the compression spring 146 is urging the intermediate member 139 and hence the mandrel 120 and cam sleeve 100 in an upstream direction (i.e. to the right in FIG. 11). The upstream travel of the camming sleeve 100, and hence the mandrel 120 and other components downstream of the mandrel 120, is limited by the ball 143 coming to a rest position in the groove 102. In this particular rest position any fluid entering the illustrated equipment from the upstream end (i.e. from the right hand end in FIG. 11) passes through the interior of the upper housing connector 133, through the indexing mechanism 134, through the piston assembly 135 and then, on leaving the shroud 136, is free to continue through the interior of the nozzle 137 and then the interior of the lower housing connector 132, or to escape through the ports 138, whichever offers the least resistance.

Thus in the arrangement illustrated in FIG. 11 the ball bearing 143 can be thought of as being at the rest position A as shown in FIG. 4.

If drilling fluid (also known as drilling mud) is then introduced into the equipment from the upstream region under sufficient pressure, that fluid will act sufficiently strongly on the choke plate 126 as to cause the indexing mechanism 134 to move downstream within the main housing 131. During such downstream movement the ball bearing cam follower 143 is following the next ramp of the groove until it comes, at the end of the ramp, to a step and thus to its next rest position. Thus, as during that movement the relative movement of the ball bearing 143 is from rest position A (shown in FIG. 4) along the relevant ramp to rest position B (shown in FIG. 4) it would have undergone maximum travel and will have forced the intermediate member 139, piston assembly 135 and shroud 136 downwards, overcoming the upward action of the spring 146, until the shroud 136 forms a sealing fit with the nozzle 137, thus blocking off the escape route to the lateral ports 138, whereby all drilling fluid introduced under pressure into the upper housing connector 132 necessarily passes out through the lower housing connector 132. Thus drilling fluid can be fed exclusively to the drilling bit in the desired manner. When however it is wished to make it possible for the drilling fluid to by-pass the drill bit, it is necessary to provide access to the lateral ports 138, and this is achieved by a temporary reduction in pressure of the drilling fluid coming from the drilling platform, which allows the action of the compression spring 146 to predominate, thereby forcing the indexing mechanism 124 to move upstream (to the right within FIG. 11) within the main housing 131 until the ball bearing 143 has travelled along the next ramp and step to reach the rest position C (in FIG. 4), at which position the lateral ports 138 are accessible to the drilling fluid under pressure within the equipment, whereby the by-pass facility is again available. Having thus caused the indexing mechanism to be in such a position that the ball bearing 143 is at position C, a subsequent significant increase in pressure in drilling fluid causes the resultant force on the indexing mechanism 134 to override the action of the spring 146 and to move downwards but that downward movement is limited by the short length of the path from the rest position C to the rest position D (shown in FIG. 4), and the pressure of drilling fluid can be raised to a very significant level without causing any further downward movement of the indexing mechanism. In view of the limited downward travel of the indexing mechanism and hence shroud 136, the ports 138 remain accessible. In fact, it takes a reduction in fluid pressure to allow the action of the spring 146 to predominate, thereby, in effect, causing the ball bearing 143 to move from the rest position D to the initial rest position A (as shown in FIG. 4).

In the arrangement illustrated in FIG. 11, it is the nozzle 137 which enters the shroud 130 to cause a good sealing fit, to preclude escape of drilling fluid to the lateral ports 138. However, if desired, the nozzle 137, instead of fitting within the shroud 136 could be reversed so that the component at the lowermost end of the piston assembly 135 is a nozzle capable of being inserted within a suitably receptive shroud fitting in the upstream end region of the lower housing connector 132.

Figure 13:
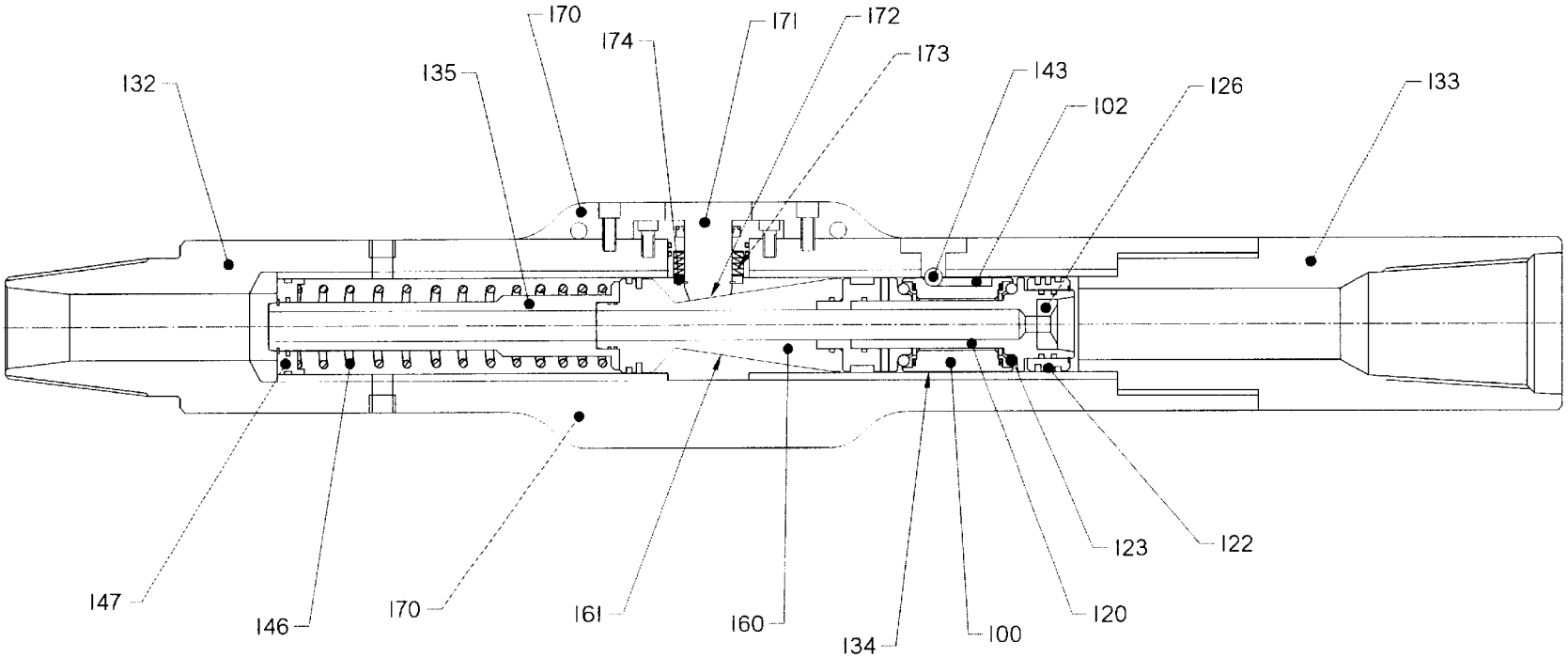
FIG. 13 is a longitudinal section through an embodiment of a stabilizer in accordance with the present invention.
Figure 14:
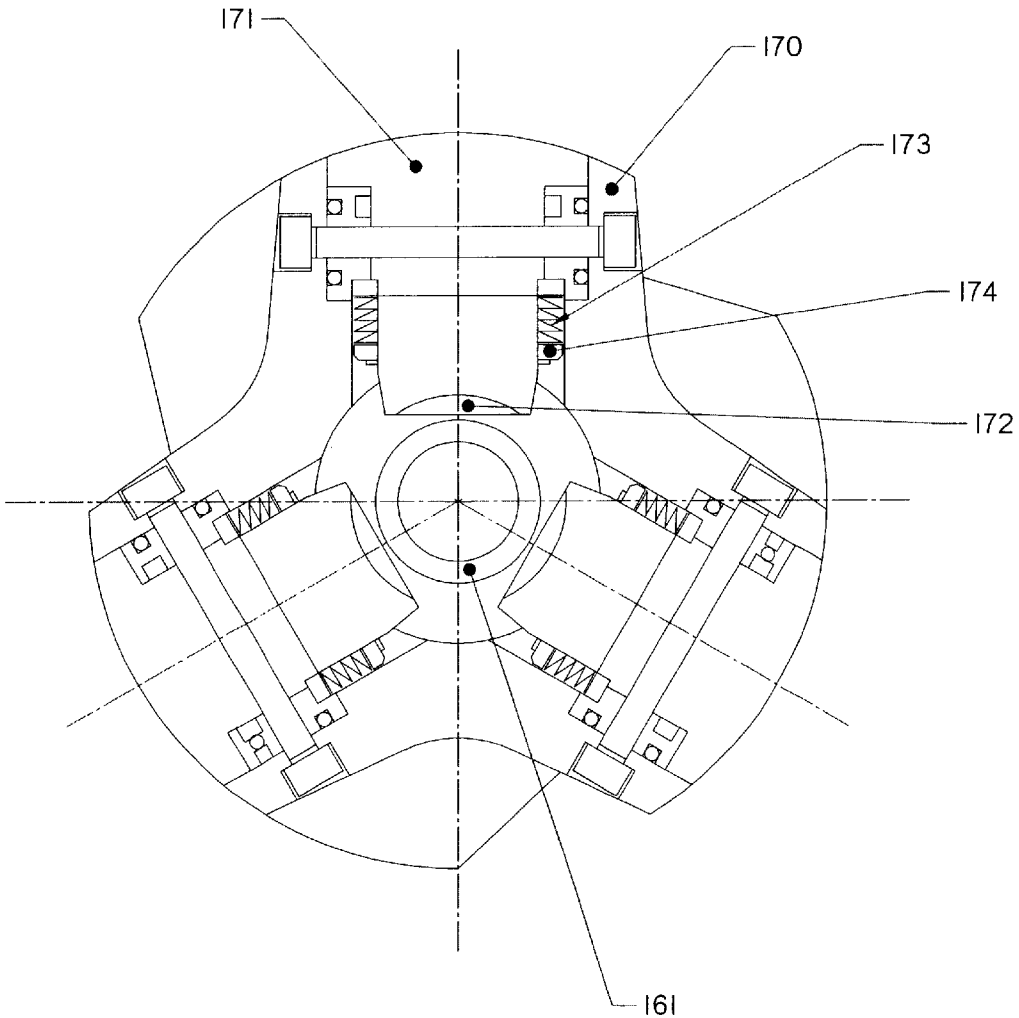
FIG. 14 is a cross-section taken through the stabiliser of FIG. 13, at a location level with the stabilising elements.

FIGS. 13 and 14 show a different piece of equipment, in fact a stabilizer. Many of the components illustrated in FIG. 13 are identical or similar (in nature and function) to corresponding components shown in FIG. 11 or in earlier figures and, to ease comprehension of the invention, corresponding components, regardless of whether they are identical or merely similar, are indicated in FIG. 13 by the same reference numerals as the components shown in earlier figures. There are, shown for the first time in FIG. 13, an actuating means 160 located between the downstream end region of the indexing mechanism 134 and the upstream end region of the piston assembly 135. The actuating means 160 has a conical cammed surface 161 which tapers in the downstream direction (i.e. tapers towards the left in FIG. 13).

Mounted externally and projecting radially from the main housing 131 is a plurality of fins 170, in this case three such fins. Located within each fin is a radially movable stabilizing element 171 which has on a radially inward region a camming surface 172 capable of cooperating with the conical cammed surface 161 of the actuating means 160. The stabilizing elements 171 are urged into the retracted position by the action of compression springs 173 acting on flanges 174 associated with the elements 171. In the actual configuration shown in FIG. 13, the actuating means 160 is at such a location as to allow the stabilizing elements 171 to be fully retracted within the fins 170, and in a position such as this the major compression spring 146 can be thought of as dominating any fluid pressure acting on the choke plate 126 of the indexing mechanism 134. Thus, it is noted that the indexing mechanism 134 is at its upstream position with the camming ball 143 abutting a downstream rest position, for instance position A, of the groove 102.

If any drilling fluid being introduced under pressure downstream through the equipment is increased in pressure, this will increase the pressure on the choke plate 126 and if the force acting on that plate rises sufficiently it can dominate the force acting in the opposite direction caused by the compression spring 146. When this happens the indexing mechanism 134 will be caused to move downstream (i.e. to the left in FIG. 13), and this causes corresponding downstream movement of the actuating means 60. This, in turn, causes the conical cammed surface 161 to act on the camming surface 172 of each stabilizing element 171, thereby causing outward radial movement of the stabilizing elements 171. The indexing mechanism (and associated downstream components) are limited in their downstream travel by the longitudinal component of the groove 102 in the cam sleeve 100, as the ball bearing 143 will only permit limited travel of the cam sleeve 100. By this stage the ball 143 can have moved to rest position B.

If, in a particular mode, the ramp (track) available within the groove 102 to be followed by the ball bearing 143 allows maximum travel of the indexing mechanism 134 of the downstream direction (as is the case at position B), the stabilizing elements 171 can be fully extended radially. By subsequently reducing and increasing the pressure in the drill fluid being introduced downstream through the equipment, the force of the compression spring 146 is allowed to dominate, or be subservient to, the force acting on the choke plate 126, thereby causing the indexing mechanism to move backwards and forwards longitudinally within the main housing 131, the amount of longitudinal movement in each case depending on the length of the relevant ramp within the closed loop of the groove 102.

Depending upon the precise location, in the longitudinal sense, of the rest positions around the closed loop groove, it is possible to secure the stabilizing elements in the fully extended position, the fully retracted position or some intermediate position.

Figure 15:
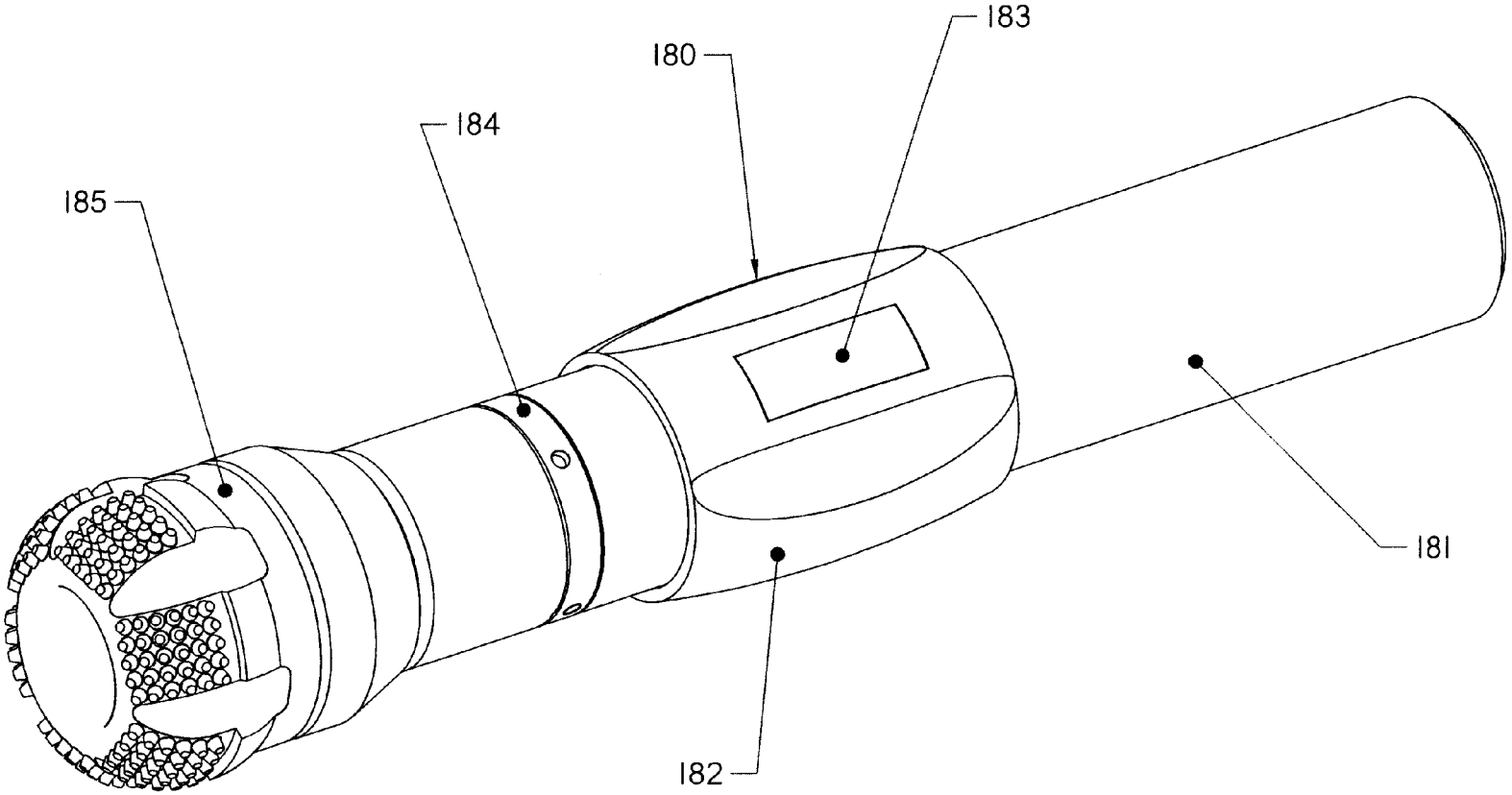
FIG. 15 is a perspective view of an embodiment of a 3-dimensional steering tool incorporating an indexing mechanism in accordance with the present invention.
Figure 16:
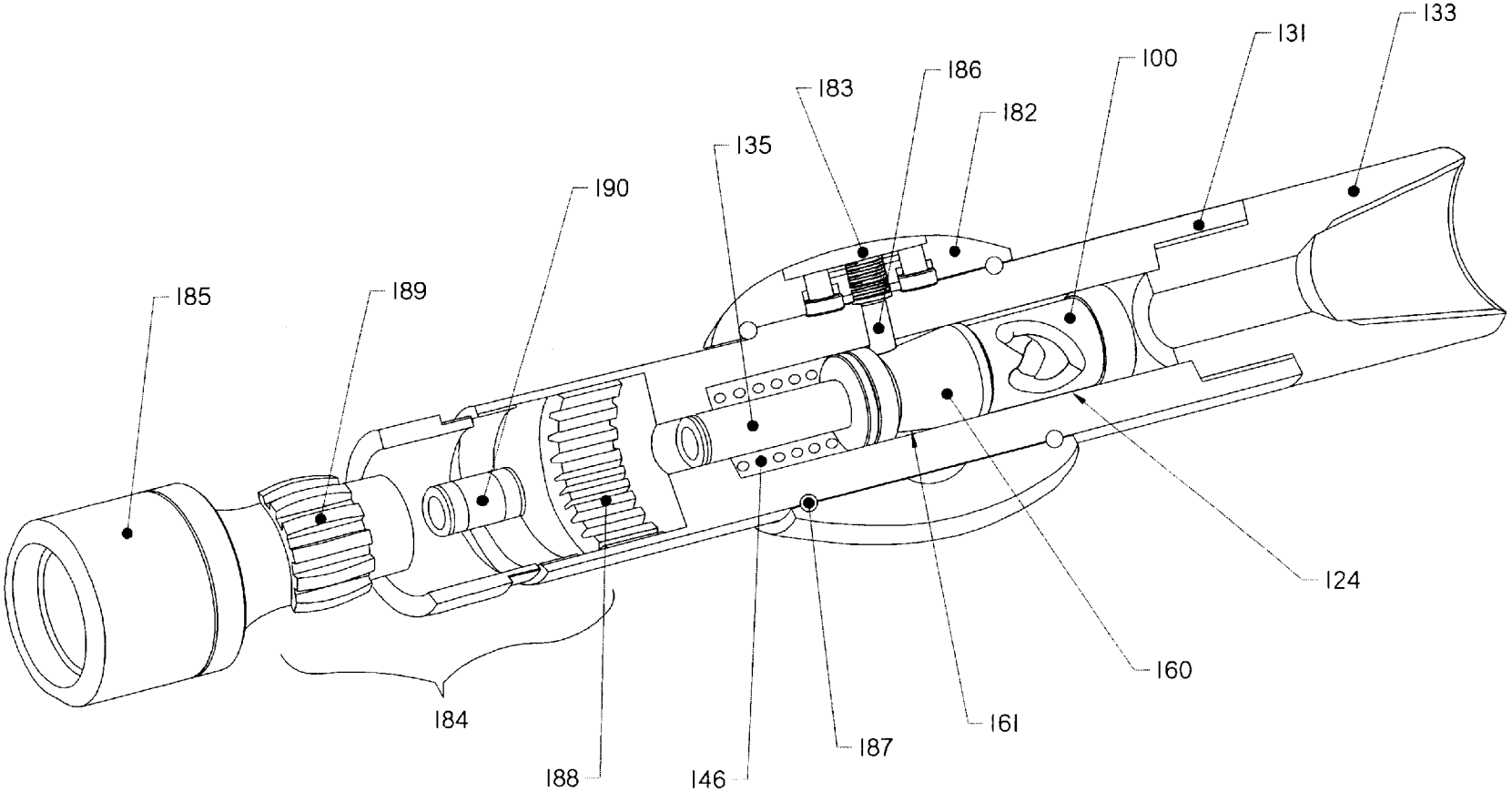
FIG. 16 is a perspective view, cut-away and partially in exploded form, of the tool of FIG. 15.
Figure 17:
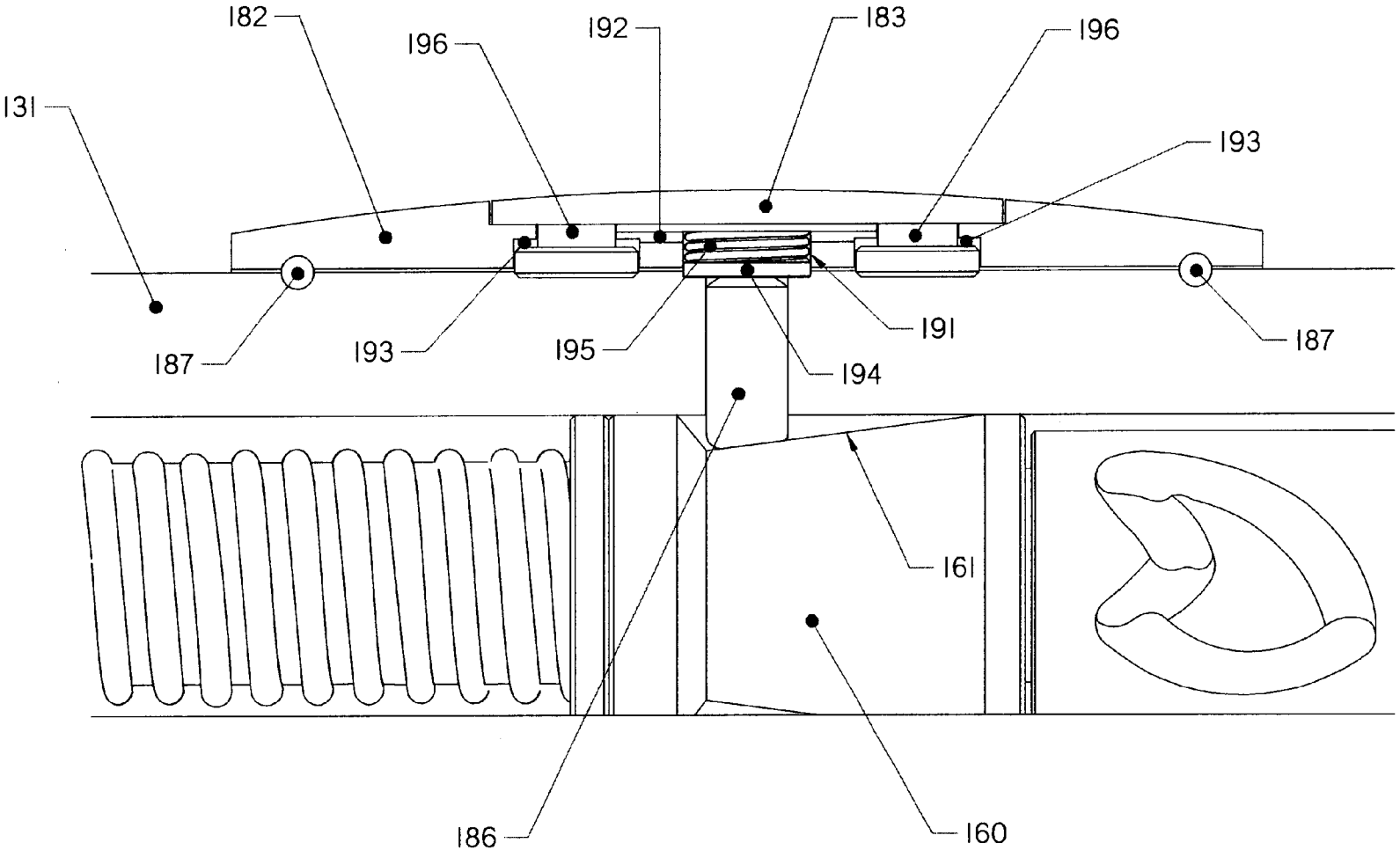
FIG. 17 is a longitudinal section, on an enlarged scale, of part of the tool of FIG. 16.

Referring now to FIGS. 15, 16 and 17 of the drawings there is shown a three-dimensional steering tool. In these drawings, where components are identical to, or correspond in function to, components in equipment described in earlier drawings, the same reference numerals are employed for ease of comprehension, even though the components might be slightly differently shaped.

With particular reference to FIG. 15, the steering tool is generally indicated by the reference numeral 180 and it includes an upstream housing 181 on which is a bearing sleeve 182 which can selectively be made rotatable or non-rotatable relative to the housing 181. The sleeve 182 is provided with a pad 183 which can be retracted into, or extended outwardly from, the sleeve 182. The housing 181 terminates in an articulated joint 184 through which drive can be passed to a drill bit 185. More detail is shown in FIG. 16 where it can be seen that within a main housing 131 is an indexing mechanism 124 having an actuator 160 having a conical cammed surface 161. Downstream of the actuator 160 is the spring and tail shaft (146/135), with rotary power being transmitted from the housing 131 via the articulated joint 184.

Longitudinal movement of the actuator 160 can cause inward or outward movement of a locking pin 186 which is mounted for radial movement within the main housing 181 which corresponds to housing 131.

The locking pin 186, when in the radially outward position, prevents rotation of the sleeve 182 relative to the main housing 131 and also (in a manner explained below) causes the pad 183 to be retracted. However, when the pin 186 is urged inwards and is permitted by the camming surface 161 to move inwards, the sleeve 182 is freed for rotation relative to the main housing 131, but the pad 183 is caused to be extended relative to the sleeve 182.

At the downstream end of the housing 131 there are provided internal gear teeth 188 capable of meshing with gear splines 189 associated with the drill bit 185 so as to cause rotation to be transmitted through the gear, whilst nonetheless permitting the axis of the drill bit 185 to be in line with the axis of the main body 131 or angled with respect to that axis. There is also a suitable flexible seal carrier 190 for conveying fluid through the gear 188/189, to the interior of the drill bit 185.

The system for controlling the sleeve 182 and the pad 183 is shown in more detail in FIG. 17.

Located within the sleeve 182 at a longitudinal position corresponding to that of the locking pin 186 is an oil filled cylinder 191 the outward end region of which communicates by a longitudinally extending path 192 with two cylindrical chambers 193. Located in the cylinder 191 opposite the locking pin 186 is a piston 194 which tends to be urged towards the locking pin 186 by a compression spring 195. In each of the two chambers 193 are further pistons 196 having heads on the underside of which fluid under pressure can act, the rams of the piston extending from the cylinders 193 and being secured to the pad 183. When the actuator 160 is in the appropriate position (i.e. upstream), the conical cammed surface 161 of the actuator 160 does not have any significant effect on the locking pin 186 with the result that the sleeve 182 is free to rotate about the main housing 131. However, the action of the compression spring 195 on the piston 194 causes the latter to move towards the locking pin 186 thus drawing fluid along the path 192 into the cylinder 191, which has the effect of causing the pistons 196 to move radially outwards in their chambers 193, thus causing the pad 183 also to move radially outwards.

When, in contrast, the indexing mechanism is actuated so at to cause the camming surface 161 of the actuator 160 to act strongly on the locking pin 186, the pin 186 is caused to move radially outwardly so as to act on the piston 194, causing that to move radially outwardly against the action of the spring 195. This causes fluid within the chamber 191 to be forced along the path 192 into the chambers 193, thereby forcing the pistons 196 radially inwards, thus retracting the pad 183 into the sleeve 182.

The operation of the indexing mechanism 124 is as described in connection with earlier pieces of equipment and it can be appreciated that different positions for the locking pin can be specified, depending on the position of the ball bearing 143 in the closed loop groove 102. It is by increasing and subsequently reducing the pressure of the drilling fluid that the indexing mechanism is activated which, in turn, causes the controlled extension and retraction of the pad 183 relative to the sleeve 182 and, respectively, the unlocking and locking of the sleeve 182 relative to the main housing 131.

Normally the pad 183 is in the retracted position, in which case the axis of the drilling bit 185 is normally in line with the axis of the main housing 131 (181). However, when it is wished to steer the drilling equipment, appropriate adjustment of the pressure of the drilling fluid causes actuation of the indexing mechanism 124 and this can cause the pad 183 to move outwards and thus to be locked with regard to the wellbore, whilst permitting rotation of the main housing 131 within the sleeve 182. However this action destroys the rectilinear nature of the equipment because, the action of the pad 183 moving in one direction causes the sleeve 182 to move in the opposite direction and, as a result of the articulated joint, the drill bit head 185 is caused to move from its original central line to a new drilling line which is on the same side as the extended pad 183. In this way steering can be achieved following known principles, the novelty residing in the use of the indexing mechanism to control the actuation of the pad 183 relative to the sleeve 182 and of the sleeve 182 relative to the main housing 131, rather than using other conventional control equipment which suffers from the shortcomings mentioned earlier herein. As articulated joints suitable for this purpose are well known, it is not intended to describe them in any detail herein.

Figure 18:
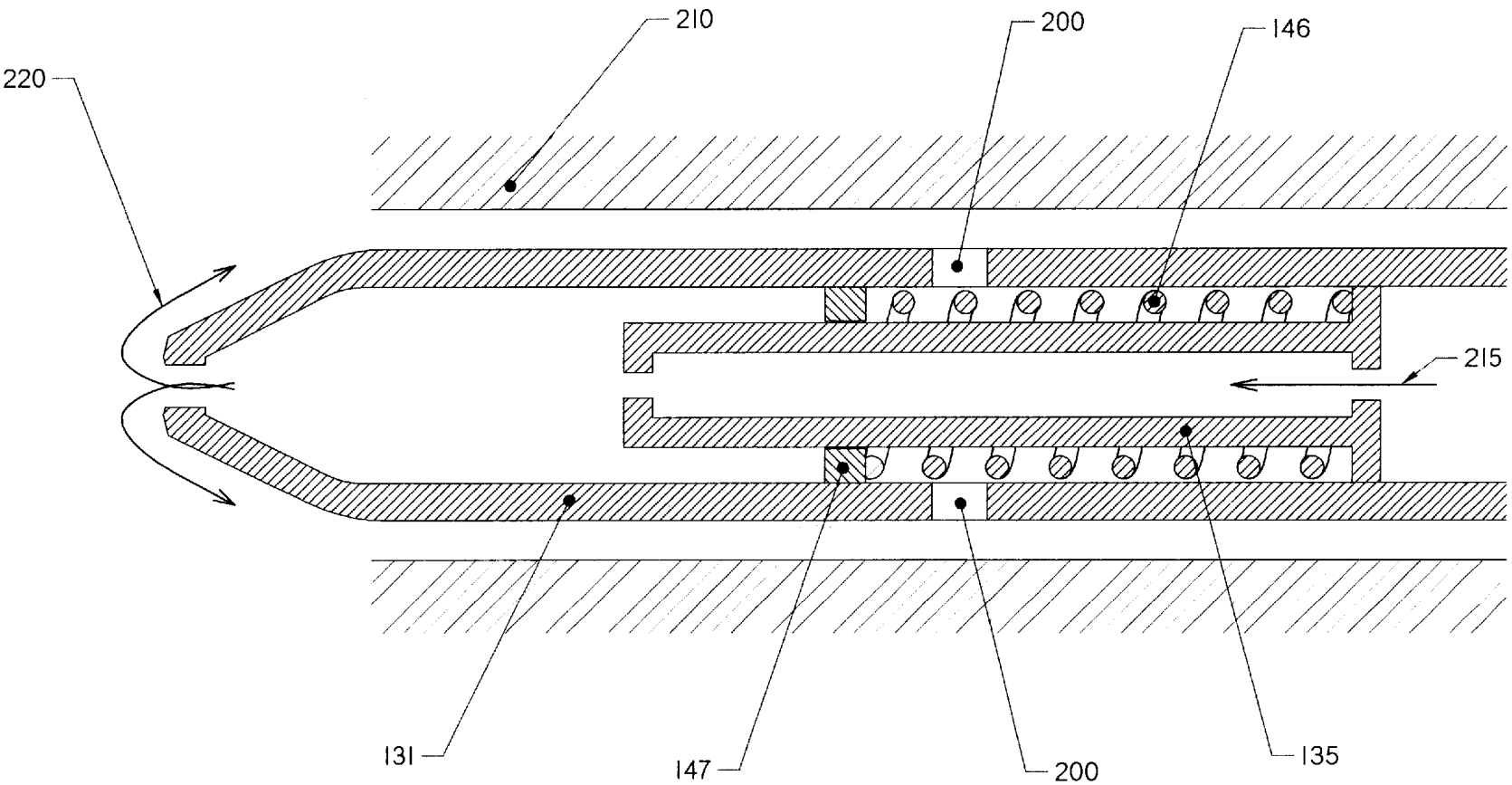
FIG. 18 shows part of the main assembly as shown in FIG. 11, located in a wellbore and incorporating a first modification.

FIG. 18 shows part only of the main by-pass assembly 130 illustrated in FIG. 11. The components indicated in FIG. 18 by the reference numerals 131, 135, 146 and 147 correspond to the correspondingly numbered components shown in FIG. 1.

It will be appreciated that, as the piston assembly 135 moves to the left (in FIGS. 11 and 18) the volume of the zone in which the compression spring 146 is located will decrease. Fluid trapped in that zone will cause resistance to further movement of the piston assembly 135 to the left, thereby possibly causing a decrease in efficiency in the operation of the by-pass assembly 130 which is situated in a wellbore 210 with drilling fluid being introduced in the direction of the arrow 215 into the upstream end of the main housing 131. Drilling fluid leaves the downstream end of the main housing 131 and returns up the wellbore 210 in the direction indicated by the arrows 220.

In order to relieve the potentially problematical increase in pressure in the aforementioned zone (where the spring 146 is located), vent holes 200 are provided in the wall of the main housing 131 to allow communication between that zone and the generally annular space between the housing 131 and the wellbore 210.

Figure 19:
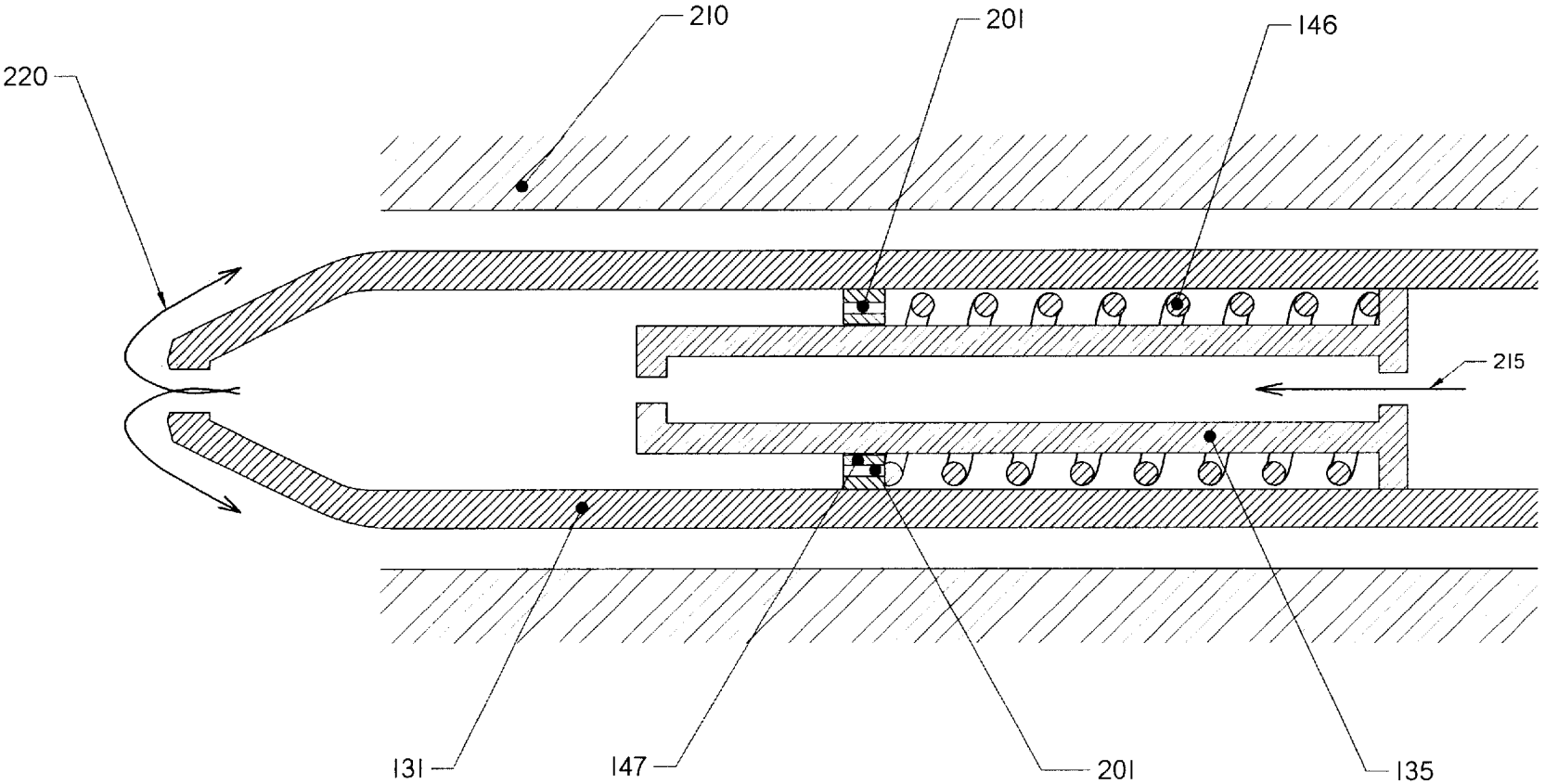
FIG. 19 shows part of the main assembly as shown in FIG. 11, located in a wellbore and incorporating a second modification.

FIG. 19 shows a variation on the modification shown in FIG. 18. Instead of providing vent holes 200 in the wall of the main housing 131 (as shown in FIG. 18), vent holes 201 are provided in the abutment plate 147 to allow fluid under pressure in the aforementioned zone to escape and to join the fluid leaving the assembly 130.

It is to be appreciated that the modifications shown and described with reference to FIG. 18 and 19 in relation to the main by-pass assembly of FIG. 11 are also applicable to the stabilizer of FIG. 13 and to the 3-dimensional steering tool of FIG. 15.

What is claimed is:

1. Within a longitudinally-extending main housing having a longitudinally-extending duct, an indexing mechanism which comprises:

a mandrel within the duct and capable of longitudinal movement relative to the main housing;

a cam sleeve mounted for rotation on, and with respect to, the mandrel but constrained in terms of longitudinal movement with respect to the mandrel, the cam sleeve having an external surface provided with a groove in the form of a closed loop;

a cam follower mounted relative to the main housing and resiliently urged into the groove of the cam sleeve;

main restoring means tending to urge the mandrel in a first direction along the duct; and a fluid abutment face, on which, in use, fluid under pressure can act to tend to urge the mandrel in a second direction opposite to the first direction;

wherein the groove has ramps and associated steps thereby restricting relative movement of the cam follower with respect to the groove, to one direction progressively around the closed loop; and wherein the groove has a plurality of rest positions at which the cam follower can rest, depending on which of the force of the main restoring means and the force of the fluid pressure dominates the other:

the arrangement of the indexing mechanism being such that, with the main restoring means initially dominating the force of fluid pressure, the mandrel is urged in the first direction and carries the cam sleeve in the first direction until the cam follower has travelled a first leg of the closed loop and comes to a first rest position in the groove; but when the fluid pressure is increased so that the force of the fluid pressure exceeds the force of the main restoring means, the mandrel is moved in the second direction, carrying the cam sleeve with it, the cam follower moving along the next leg of the closed loop of the groove until a second rest position is reached, and remaining there until the fluid pressure is reduced sufficiently such that the force of the main restoring means exceeds again the force of the fluid pressure, whereupon the mandrel moves again in the first direction, carrying the cam sleeve with it, with the cam follower travelling along a third leg of the closed loop to a third rest position.

2. An indexing mechanism according to claim 1, wherein the closed loop of the groove appears on only part of the circumferential external surface of the cam sleeve such that, in operation, during one complete cycle with the cam follower following the whole of the closed loop, the cam sleeve will rotate in opposite directions about its longitudinal axis.

3. An indexing mechanism according to claim 1, wherein the closed loop of the groove extends around the whole circumference of the cam sleeve such that, in operation, during one complete cycle the cam sleeve will undergo one complete revolution about its longitudinal axis.

4. An indexing mechanism according to claim 1, wherein the cam follower is a ball urged by resilient means into the groove.

5. An indexing mechanism according to claim 4, wherein the resilient means is a compression spring.

6. An indexing mechanism according to claim 4, wherein the ball moves in a bore which is radial with respect to the main longitudinal axis of the indexing mechanism.

7. An indexing mechanism according to claim 1, wherein the groove has four steps and four rest positions.

8. An indexing mechanism according to claim 1, wherein the groove has six steps and six rest positions.

9. An indexing mechanism according to claim 1, wherein the main restoring force is a major compression spring.

10. An indexing mechanism according to claim 1, wherein the fluid abutment face is a perforated plate on which fluid under pressure moving in the second direction can act so as to tend to cause the mandrel to move in the second direction.

11. An indexing mechanism according to claim 1, which includes bearing assemblies to assist in free rotation of the cam sleeve relative to the mandrel.

12. An indexing mechanism according to claim 1, wherein the mandrel is provided with sealing mechanisms for sealing the mandrel with respect to the internal surface of the duct of the main housing.

13. An indexing mechanism according to claim 1, which includes actuating means associated with the mandrel and capable of reciprocating longitudinal movement in the first and second directions with the mandrel.

14. An indexing mechanism according to claim 13, wherein the mandrel is hollow and the actuating means is also hollow, whereby fluid under pressure moving in the second direction can pass through the hollow bore within the mandrel and through the actuating means.

15. A drill string portion which includes a main housing incorporating an indexing mechanism according to claim 1, and an upper housing connection and a lower housing connection connected to opposite end regions of the main housing.

16. A by-pass tool which includes a drill string portion according to claim 15, wherein the main housing includes one or more lateral ports and the actuating means includes a pipe capable of forming a fluid-tight communication with another pipe such that when the two pipes are in fluid-tight communication fluid being introduced under pressure through the hollow region of the mandrel passes through the two pipes and is prevented from escaping to the port(s), the two pipes being in fluid-tight communication when the mandrel and cam sleeve have undergone maximum permitted travel in the second direction.

17. A by-pass tool according to claim 16, wherein one of the pipes includes a male nozzle component capable of cooperating with a female portion on the other of the pipes.

18. A drill string portion according to claim 15, which is provided with stabilising facilities, the facilities including elements which can be moved radially outwards so as to engage the internal face of a well bore, the elements being resiliently urged radially inwards but being associated with camming means associated with the actuating means such that, when the mandrel moves in the second direction, the actuating means are correspondingly moved and this actuates the camming means so as to cause outward radial movement of the stabilising elements, overcoming the resilient means tending to urge them inwards.

19. A drill string portion which includes a 3-dimensional rotary steering tool and which also incorporates an indexing mechanism in accordance with claim 13, the steering tool including a sleeve capable of free rotation about a housing, and the sleeve being provided with a pad capable of inward and outward radial movement, wherein the pad is normally retracted relative to the sleeve and a locking means normally serves to prevent relative rotational movement between the sleeve and the associated housing, the locking means being operated by a cam forming part of the actuating means associated with the indexing mechanism; the arrangement being such that, with the mandrel moving in the second direction, the cam is actuated so as to cause the locking means to act in such a way as to cause the sleeve to be locked relative to the housing, this also causing the pad to be retracted relative to the sleeve against other resilient means; and such that, when the mandrel is moved in the first direction, the cam is moved longitudinally so as to allow the locking means to move in such a way as to allow free rotation of the sleeve relative to the housing, and also allowing the other resilient means to cause the pad to be urged radially outwards, thus creating an eccentric configuration.

20. A drill string portion according to claim 19, which also includes an articulated drive mechanism, with the arrangement being such that, with the pad being extended in one radial direction, the resultant effect through the articulated drive mechanism is to cause a drill bit to move in the same general direction as the extended pad, whereby steering can be achieved.

21. A drill string portion which includes a 3-dimensional rotary steering tool and which also incorporates an indexing mechanism in accordance with claim 13, the steering tool including a sleeve capable of free rotation about a housing, the housing having an axis and a circular exterior of which the centre lies on the axis, the sleeve having a circular interior for rotation about the exterior of the housing and having an offset exterior having an axis which is offset with respect to that of the housing, wherein a locking means normally serves to prevent relative rotational movement between the sleeve and the associated housing, the locking means being operated by a cam forming part of the actuating means associated with the indexing mechanism; the arrangement being such that, with the mandrel moving in the second direction, the cam is actuated so as to cause the locking means to move in such a way as to cause the sleeve to be locked relative to the housing;

and such that, when the mandrel is moved in the first direction, the cam is moved longitudinally so as to cause the locking means to move in such a way as to allow free rotation of the sleeve relative to the housing, whereby in use the sleeve becomes stationary relative to a wellbore and, because of the offset nature of the stationary sleeve, steering of the steering tool is achieved.

22. A drill string portion according to claim 21, which also includes an articulated drive mechanism, with the arrangement being such that, with the eccentric housing being extended in one radial direction, the resultant effect through the articulated drive mechanism is to cause a drill bit to move in the same general direction as the eccentric housing, whereby steering can be achieved.

23. Apparatus according to claim 15, which includes at least one vent hole located to allow fluid under pressure to escape from a zone in which the main restoring force is located.

24. Apparatus according to claim 19, which includes at least one vent hole located to allow fluid under pressure to escape from a zone in which the main restoring force is located.

25. Apparatus according to claim 21, which includes at least one vent hole located to allow fluid under pressure to escape from a zone in which the main restoring force is located.

26. Within a longitudinally-extending main housing having a longitudinally-extending duct, an indexing mechanism which comprises:

a mandrel within the duct and capable of longitudinal movement relative to the main housing;

a cam sleeve mounted for rotation on, and with respect to, the mandrel but constrained in terms of longitudinal movement with respect to the mandrel, the cam sleeve having an external surface provided with a groove in the form of a closed loop;

a cam follower mounted relative to the main housing and resiliently urged into the groove of the cam sleeve;

main restoring means tending to urge the mandrel in a first direction along the duct; and a fluid abutment face, on which, in use, fluid under pressure can act to tend to urge the mandrel in a second direction opposite to the first direction;

wherein the groove has ramps and associated steps thereby restricting relative movement of the cam follower with respect to the groove, to one direction progressively around the closed loop, the steps defining positions at which the cam follower can rest.

27. An indexing mechanism according to claim 26, wherein the closed loop of the groove is so configured that, in operation, as the cam follower follows the closed loop the cam sleeve will move alternately in opposite longitudinal directions.

* * * * *